US006994614B2

(12) United States Patent
Takemura et al.

(10) Patent No.: US 6,994,614 B2
(45) Date of Patent: Feb. 7, 2006

(54) METAL-BONDED GRINDING TOOL

(75) Inventors: Sokichi Takemura, Iwata-gun (JP); Tadao Ishikawa, Mobara (JP)

(73) Assignee: Tenryu Seikyo Kabushiki Kaisha, Iwata-gun (JP)

( * ) Notice: Subject to any disclaimer, the term of this patent is extended or adjusted under 35 U.S.C. 154(b) by 19 days.

(21) Appl. No.: 10/647,230

(22) Filed: Aug. 26, 2003

(65) Prior Publication Data

US 2004/0043716 A1 Mar. 4, 2004

(30) Foreign Application Priority Data

Aug. 27, 2002 (JP) ..... 2002-247005

(51) Int. Cl.
*B23F 21/03* (2006.01)

(52) U.S. Cl. ..... 451/541; 451/548

(58) Field of Classification Search ..... 451/540, 451/541, 546, 547, 548; 51/295, 307, 309
See application file for complete search history.

(56) References Cited

U.S. PATENT DOCUMENTS

| | | | | |
|---|---|---|---|---|
| 5,832,360 | A | 11/1998 | Andrews et al. | |
| 5,846,269 | A * | 12/1998 | Shiue et al. | 51/295 |
| 6,102,789 | A * | 8/2000 | Ramanath et al. | 451/541 |
| 6,200,208 | B1 * | 3/2001 | Andrews et al. | 451/548 |

FOREIGN PATENT DOCUMENTS

| | | |
|---|---|---|
| EP | 0 864 399 A2 | 9/1998 |
| JP | 2001-25969 | 1/2001 |
| WO | 98/05466 | 2/1998 |

* cited by examiner

*Primary Examiner*—Dung Van Nguyen
(74) *Attorney, Agent, or Firm*—Armstrong, Kratz, Quintos, Hanson & Brooks, LLP

(57) ABSTRACT

A metal-bonded grinding tool including a base and abrasive grains bonded to the base by means of a metal bond matrix containing a Cu alloy as a main component. A content of at least one of an alloy phase, a mixed phase, and an intermetallic compound of Zr and Ti in the metal bond matrix is in a range of 3.8 to 19.2 wt %.

5 Claims, 3 Drawing Sheets

METAL-BONDED GRINDING TOOL

BACKGROUND OF THE INVENTION

1. Field of the Invention

The present invention relates to a metal-bonded grinding tool obtained by fixing abrasive grains to a base of a tool by means of a metal bond matrix.

2. Description of the Related Art

A known method of manufacturing metal-bonded grinding tools involves mixing abrasive grains with a metal powder, compacting the mixture into a given shape, and sintering the green compact integrally with a base of a tool, thereby fixing the abrasive grains to the base of the tool (impregnated sintered tool). Another known method for manufacturing metal-bonded grinding tools involves placing abrasive grains on a base of a tool, and applying nickel plating (electrically or chemically) so as to cover the abrasive grains with nickel metal deposited, thereby mechanically fixing the abrasive grains to the base by means of the deposited nickel metal.

These conventional metal-bonded grinding tools, however, have a problem. Since the abrasive grains are fixed only mechanically to the metal bond matrix, the force of retaining the abrasive grains by means of the metal bond matrix is weak, thereby causing the abrasive grains to fall out of the metal bond matrix in a relatively short period of time. Another problem is that since the height of each abrasive grain projecting from the metal bond matrix is small, an exposed portion of the metal bond matrix comes into contact with a workpiece to be ground and thereby tends to cause contact resistance and erosion wear, resulting in the degraded grinding ability and durability of the grinding tool.

The erosion wear of the metal bond matrix easily caused in the conventional metal-bonded grinding tools as described above gives rise to a further problem. When the abrasive grains become exposed from the metal bond matrix by erosion wear of the metal bond matrix, such abrasive grains easily fall out of the metal bond matrix because no chemical bonding between the metal bond matrix and the abrasive grains. This significantly reduces the usability of the abrasive grains, thereby causing unstable grinding and significantly shortening the life of the tool.

A metal-bonded grinding tool capable of solving the above-described conventional problems has been proposed by the present applicant (see Japanese Patent Laid-open No. 2001-25969). The metal-bonded grinding tool described in this document is characterized in that abrasive grains are bonded to a base of the tool by means of a metal bond matrix containing a Cu alloy as a main component, wherein the metal bond matrix contains a material selected from a group consisting of Ti, Al, and a mixture thereof. Such a metal-bonded grinding tool is advantageous in that Ti, a Ti compound, Al, or an Al compound has a property capable of making abrasive grains wet by its reducing ability, to form chemical bonding between the metal bond matrix and the abrasive grains, thereby strongly bonding the abrasive grains to the metal bond matrix. This prevents the abrasive grains from falling out of the metal bond matrix, thereby keeping a stable grinding performance for a long time.

The metal-bonded grinding tool described in the above-described document has a high grinding performance capable of satisfying general grinding requirements, but as a result of examination of the present inventor, it was confirmed that such a metal-bonded grinding tool may often cause an inconvenience that the abrasive grains fall out of the metal bond matrix when used for grinding a very hard material such as stone for a long time.

SUMMARY OF THE INVENTION

It is therefore an object of the present invention to provide a metal-bonded grinding tool capable of preventing abrasive grains from falling out of a metal bond matrix, thereby stably keeping a high grinding performance during a long period of time.

In accordance with an aspect of the present invention, there is provided a metal-bonded grinding tool including a base, and abrasive grains bonded to the base by means of a metal bond matrix containing a Cu alloy as a main component, wherein the metal bond matrix contains at least one of an alloy phase, a mixed phase, and an intermetallic compound of Zr and Ti.

Preferably, a content of the at least one of an alloy phase, a mixed phase, and an intermetallic compound of Zr and Ti in the metal bond matrix is in a range of 3.8 to 19.2 wt %, more preferably, 6.4 to 14.1 wt %. A weight ratio of Ti to Zr is preferably in a range of 0.5 to 2.0, more preferably, 0.7 to 1.3.

The Cu alloy is preferably selected from a group consisting of a bronze containing 10 to 33 wt % of Sn, a brass containing 5 to 20 wt % of Zn, and an aluminum bronze containing 5 to 20 wt % of Al. The abrasive grains used herein are abrasive grains of a material selected from a group consisting of diamond, cubic boron nitride (CBN), silicon carbide (SiC), and cemented carbide. In addition, the abrasive grains of cemented carbide may be obtained by pulverizing the cemented carbide.

The metal-bonded grinding tool of the present invention configured as described above is advantageous in that since heights of the abrasive grains projecting from the metal bond matrix are very large, the removability of chips of a workpiece to be ground from the tool can be improved, and since the metal bond matrix is not brought into contact with the workpiece, the grinding resistance can be reduced. As a result, it is possible to ensure high grindability and good dissipation of grinding heat.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENT

Figure 1:
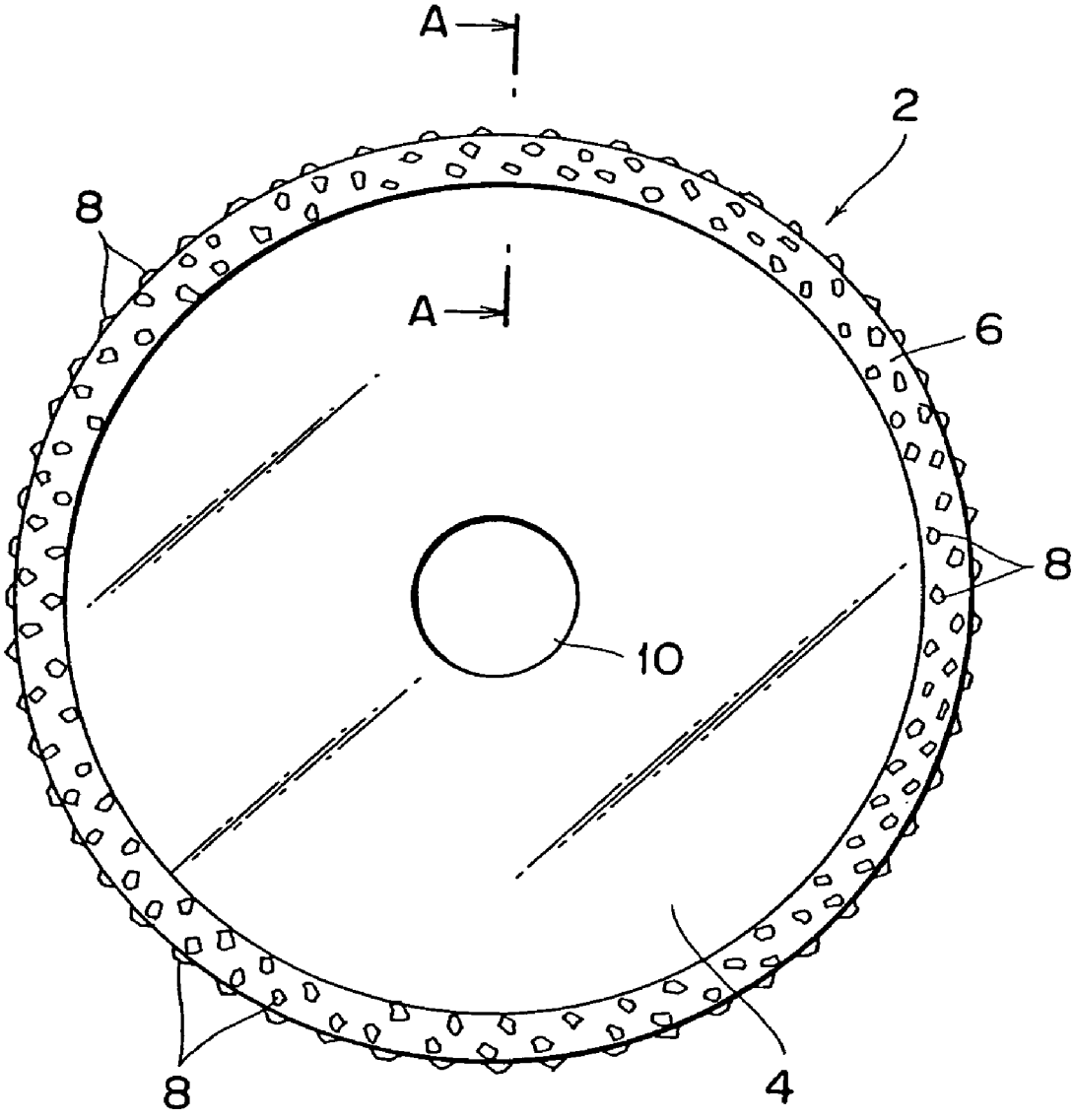
FIG. 1 is a side view of a grinding tool of the present invention.
Figure 2:
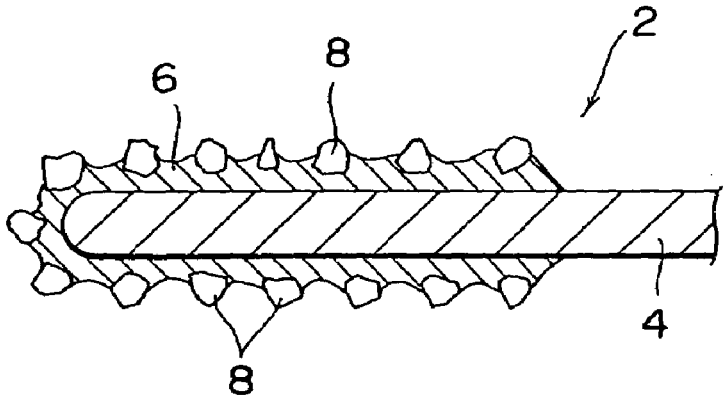
FIG. 2 is an enlarged sectional view taken on line A—A of FIG. 1.

The present invention will now be described with reference to the drawings, in which a preferred embodiment is shown. FIG. 1 is a side view of a disk-shaped grinding tool 2 according to a preferred embodiment of the present invention, and FIG. 2 is a sectional view taken along line A—A in FIG. 1. Referring to FIG. 1, there is shown a disk-shaped grinding tool 2 including a base 4 having a center mounting hole 10. The grinding tool 2 is mounted on a grinding machine by fitting a shaft of the grinding machine in the mounting hole 10 of the base 4.

As best shown in FIG. 2, a number of diamond abrasive grains 8 are fixedly bonded to an outer peripheral portion of the base 4 by means of a metal bond matrix 6. The metal bond matrix 6 contains a bronze containing 10 to 33 wt % of Sn, a brass containing 5 to 20 wt % of Zn, or an aluminum bronze containing 5 to 20 wt % of Al as a main component, and further contains 3.8 to 19.2 wt % of an alloy phase, a missed phase, or an intermetallic compound of Zr and Ti.

The present invention has originated from the metal-bonded grinding tool disclosed in Japanese Patent Laid-open No. 2001-25969, and found that as a result of adding a specific amount of Zr together with Ti in the metal bond matrix, the bonding strength of the abrasive grains to the metal bond matrix is increased by synergistic effect of Zr and Ti. A method of manufacturing a metal-bonded grinding tool according to the preferred embodiment of the present invention will be described below.

A powder of a bronze containing 23 wt % of Sn, a powder of a Zr compound, a powder of a Ti compound, and 22 wt % of stearic acid as a binder were mixed into a binder mixture (bond mixture). The binder mixture was then kneaded in a kneader, to obtain a paste mixture. Zr and Ti were added in the binder mixture in the form of compounds in this embodiment; however, they may be added in the binder mixture in the form of elements. If Zr and Ti are added in the form of compounds as in this embodiment, they may be added in the form of zirconium hydride ($ZrH_2$) and titanium hydride ($TiH_2$), respectively, which are dissociated during a brazing step.

A plurality of paste mixtures having different compositions were prepared in accordance with the same manner as described above. In this preparation of the paste mixtures, while the content of stearic acid as the binder was kept at 22 wt %, each of the contents of a powder of $ZrH_2$ and a powder of $TiH_2$ was changed in a range of 1.0 to 8.5 wt % as shown in Table 1, the balance being a powder of a bronze as shown in Table 1. These paste mixtures were kneaded in a kneader, to obtain a plurality of paste mixtures having different compositions. Each of these paste mixtures was applied on the surface of a steel test piece (size: 12×20 mm) by using a spatula. In this case, to obtain a desired thickness of the metal bond matrix 6, it is preferable to remove an excessive amount of the applied paste mixture by using a thickness gauge jig so as to adjust the thickness of the applied paste mixture to a given uniform thickness.

Abrasive grains of diamond in a necessary amount were scattered on the paste mixture so as to adhere thereon. The test piece was then put into a vacuum furnace, followed by evacuation to a vacuum degree of 3.9 Pa, and was kept at 920□ for 20 minutes in the vacuum furnace. The test piece was then removed from the vacuum furnace and cooled to ordinary temperature. During heating of the test piece in the vacuum furnace, titanium hydride is dissociated into titanium and hydrogen, and zirconium hydride is dissociated into zirconium and hydrogen. The stearic acid as the binder is substantially perfectly evaporated with no residue during brazing.

By keeping the test piece in the vacuum furnace at 920□ for 20 min, the paste mixture is melted, and is solidified during cooling to ordinary temperature. As a result, the abrasive grains of diamond are bonded to the test piece via the metal bond matrix. As is known to those skilled in the art, each of Zr and Ti has a property capable of making abrasive grains of diamond wet, and is solid-soluble in bronze. As a result, the abrasive grains of diamond are chemically, strongly bonded to the metal bond matrix, thereby preventing the abrasive grains of diamond from falling out of the metal bond matrix.

Figure 3:
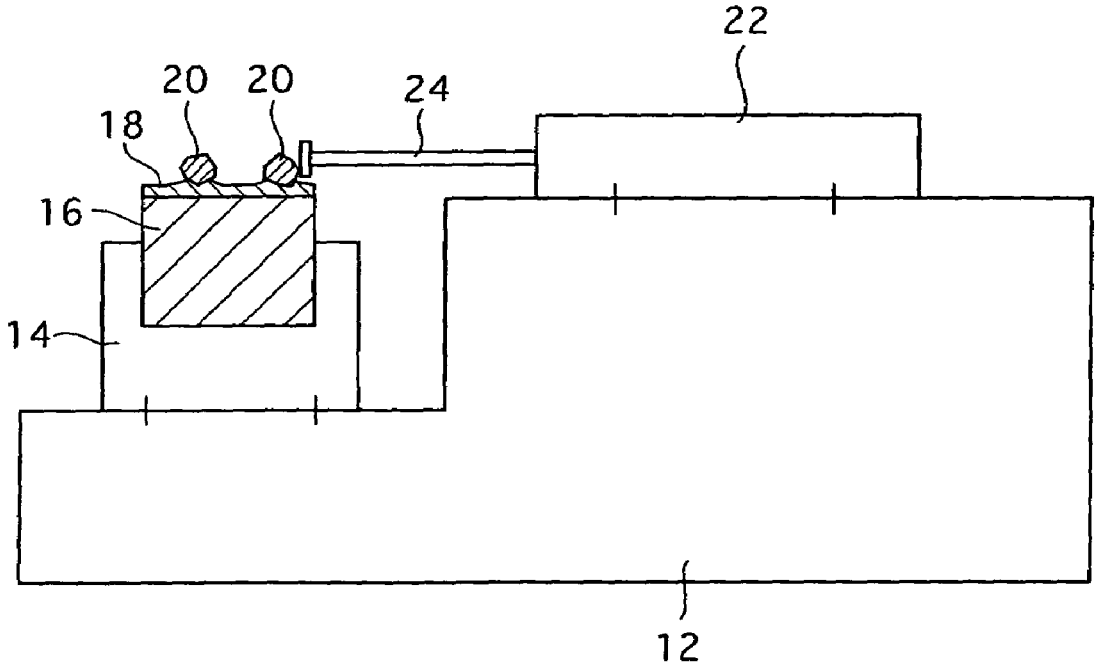
FIG. 3 is a schematic view of a bonding strength measuring device.

Each of the test pieces including the metal bond matrixes having the plurality of compositions was set to a bonding strength measuring device shown in FIG. 3, and the bonding strength of the abrasive grains of diamond for each test piece was measured. The results are shown in Table 1

TABLE 1

| | | | | | | | | | | |
|---|---|---|---|---|---|---|---|---|---|---|
| Zr | Mixture | 1.0 | 1.5 | 2.5 | 3.5 | 4.5 | 5.5 | 6.5 | 7.5 | 8.5 |
| wt % | Product | 1.3 | 1.9 | 3.2 | 4.5 | 5.8 | 7.05 | 8.3 | 9.6 | 10.9 |
| Ti | Mixture | 1.0 | 1.5 | 2.5 | 3.5 | 4.5 | 5.5 | 6.5 | 7.5 | 8.5 |
| wt % | Product | 1.3 | 1.9 | 3.2 | 4.5 | 5.8 | 7.05 | 8.3 | 9.6 | 10.9 |
| Strength (N) | | 41.1 | 63.8 | 70.3 | 72.3 | 73.1 | 71.8 | 68.1 | 65.9 | 46.1 |

In this test, the contents of Zr and Ti were set to equal to each other, and were each changed in a range of 1.0 wt % to 8.5 wt %. The measurement of the bonding strength of the abrasive grains of diamond for each test piece was repeated by 15 times, and the average value thereof was taken as the bonding strength of the abrasive grains of diamond for the test piece. It is to be noted that the reason why not only the content of each of Zr and Ti in the mixture but also the content of each of Zr and Ti in the product is shown in Table 1 is that an amount of 22 wt % of stearic acid as the binder is added but such stearic acid is perfectly evaporated during brazing. Accordingly, the content of each of Zr and Ti in the product can be obtained by dividing the content of each of Zr and Ti in the mixture by 0.78.

In FIG. 3, a clamp 14 is fixed to a base 12, and a test piece 16 is strongly clamped by the clamp 14. On the test piece 16, abrasive grains 20 of diamond are bonded to a metal bond matrix 18. An electric load cell 22 is fixed on the base 12 by a screw or the like, and the bonding strength of the abrasive grains 20 of diamond are measured by pressing the abrasive grains 20 of diamond by a piston 24 of the electric load cell 22.

As is apparent from Table 1, if the total content of Zr and Ti is 2.6 wt %, the bonding strength is as small as 41. 1 Newton (N), whereas if the total content is 21.8 wt %, the bonding strength is also as small as 46.1 N. Accordingly, to obtain a sufficient bonding strength of abrasive grains of diamond, the total content of Zr and Ti is preferably in a range of 3.8 to 19.2 wt %, more preferably, in a range of 6.4 to 14.1 wt %. If the total content of Zr and Ti is in the range of 6.4 to 14.1 wt %, the bonding strength of 70 N or more can be obtained.

Figure 4:
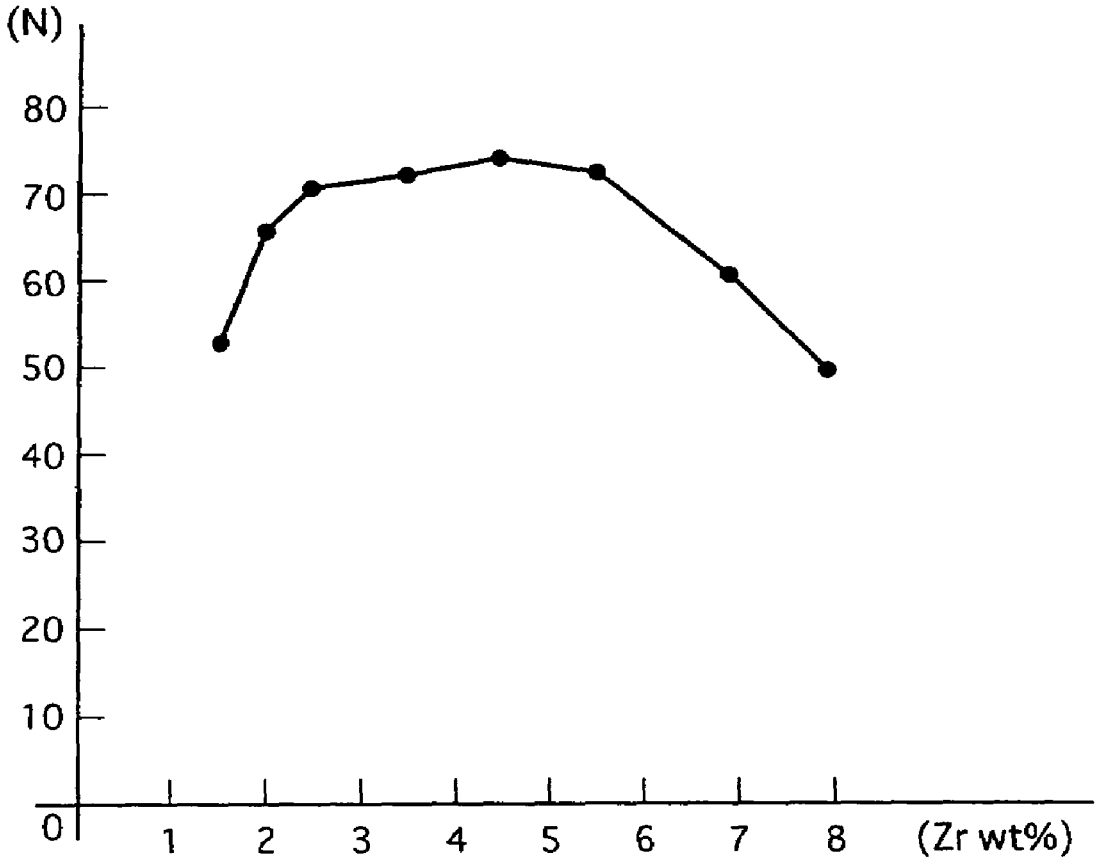
FIG. 4 is a graph showing a dependency of a bonding strength of the tool on a Zr content.

The same measurement was repeated for each of test pieces prepared with the content of Ti fixed at 3.5 wt % and the content of Zr changed in a range of 1.5 wt % to 8.0 wt %. The results are shown in FIG. 4. As shown in FIG. 4, if the content of Zr is 1.5 wt %, the bonding strength becomes as small as about 53 N, and if the content of Zr is 8 wt %, the bonding strength becomes as small as about 49 N. Accordingly, the content of Zr is preferably in a range of 2.0 to 7.0 wt % with the content of Ti fixed to 3.5 wt %. In other words, the added ratio of Ti to Zr is preferably in a range of 0.5 to 2.0 times, more preferably, 0.7 to 1.5 times.

A comparative test was performed by preparing a test piece by using a binder mixture containing a powder of a bronze, a Ti compound, and a stearic acid as a binder, that is, containing no Zr, and measuring the bonding strength of the test piece. The results are shown in Table 2.

TABLE 2

| | | | |
|---|---|---|---|
| Ti wt % | Mixture | 5.0 | 7.0 |
| | Product | 6.4 | 9.0 |
| Zr wt % | Mixture | 0 | 0 |
| | Product | 0 | 0 |
| Strength (N) | | 48.3 | 54.9 |

As is apparent from Table 2, for the test piece using the binder mixture containing only Ti, that is, containing no Zr, the bonding strength of abrasive grains of diamond is significantly poor as compared with the test piece using the binder mixture containing both Zr and Ti. Accordingly, it is confirmed that when Zr and Ti are added to the metal bond matrix at a specific total ratio, the bonding strength of the abrasive grains of diamond can be significantly reinforced by synergistic effect of Zr and Ti.

The copper alloy may be a bronze containing 10 to 33 wt % of Sn, a brass containing 5 to 20 wt % of Zn, or an aluminum bronze containing 5 to 20 wt % of Al. In particular, the aluminum bronze is preferable. This is because even when the vacuum degree upon heating is low, the abrasive grains can be bonded to the metal bond matrix by addition of a small total amount of the Zr compound and Ti compound. When the tool of the present invention is used as a cutting tool, the sizes of abrasive grains of diamond may be in a range of 20 or 80 mesh, and when used as a grinding tool, the sizes of abrasive grains of diamond may be in a range of 80 to 400 mesh. The abrasive grains are not limited to those of diamond but may be those of CBN, SiC (silicon carbide), or cemented carbide. The binder is not limited to stearic acid but may be paraffin or polyglycol. These materials may be used singly or in combination.

According to the grinding tool of the present invention, since the abrasive grains are chemically strongly fixed to the metal bond matrix due to the synergistic effect of Zr and Ti, such abrasive grains are prevented from falling out of the metal bond matrix, whereby the grinding tool can maintain a long-term, stable grinding performance. Since the abrasive grains do not fall out of the metal bond matrix, it is possible to enhance the usability of the abrasive grains, and hence to reduce the cost of the grinding tool. Since heights of abrasive grains projecting from the metal bond matrix can be made very large, the removability of the chips of a workpiece to be ground can be improved, and since the metal bond matrix does not come into contact with the workpiece, the grinding resistance can be reduced. As a result, it is possible to ensure a high grinding performance and a high dissipation performance for grinding heat.

While the preferred embodiment has been described using specific terms, such description is for illustrative purposes only, and it is to be understood that changes and variations may be made without departing from the spirit or scope of the following claims.

What is claimed is:

1. A metal-bonded grinding tool comprising:

a base; and abrasive grains bonded to said base by means of a metal bond matrix, said metal bond matrix consisting essentially of:

a Cu alloy as a main component;

zirconium; and titanium;

said zirconium and said titanium being present as one of an alloy phase, a mixed phase, and an intermetallic compound, and wherein a content of said at least one of an alloy phase, a mixed phase, and an intermetallic compound of Zr and Ti in said metal bond matrix is in a range of 3.8 to 19.2 wt %.

2. A metal-bonded grinding tool according to claim 1, wherein a weight ratio of Ti to Zr is in a range of 0.5 to 2.0.

3. A metal-bonded grinding tool according to claim 1, wherein said Cu alloy is selected from a group consisting of a bronze containing 10 to 33 wt % of Sn, a brass containing 5 to 20 wt % of Zn, and an aluminum bronze containing 5 to 20 wt % of Al.

4. A metal-bonded grinding tool according to claim 1, wherein said abrasive grains are abrasive grains of a material selected from a group consisting of diamond, cubic boron nitride, silicon carbide, and cemented carbide.

5. A metal-bonded grinding tool, comprising:

a base; and abrasive grains bonded to said base by means of a metal bond matrix containing a Cu alloy as a main component;

wherein said metal bond matrix contains at least one of an alloy phase, a mixed phase, and an intermetallic compound of Zr and Ti, wherein the content of said at least one of an alloy phase, a mixed phase, and an intermetallic compound of Zr and Ti in said metal bond matrix is in a range of 6.4 to 14.1 wt %.

* * * * *